United States Patent [19]

Tomasetti et al.

[11] 4,347,458

[45] Aug. 31, 1982

[54] PHOTOMULTIPLIER TUBE HAVING A GAIN MODIFYING NICHROME DYNODE

[75] Inventors: Charles M. Tomasetti, Leola; John A. Ulaky, Washington Boro, both of Pa.

[73] Assignee: RCA Corporation, New York, N.Y.

[21] Appl. No.: 134,276

[22] Filed: Mar. 26, 1980

[51] Int. Cl.[3] ..... H01J 43/00

[52] U.S. Cl. ..... 313/103 R; 313/104; 313/106

[58] Field of Search ..... 313/95, 101, 103 R, 313/105, 106, 107; 427/77

[56] References Cited

U.S. PATENT DOCUMENTS

| | | | |
|---|---|---|---|
| 2,390,701 | 12/1945 | Ferris . | |
| 2,942,132 | 6/1960 | Rotow et al. . | |
| 3,346,752 | 10/1967 | Battson . | |
| 3,449,582 | 6/1969 | Sackinger . | |
| 3,891,884 | 6/1975 | Tisdale | 313/107 |
| 3,974,411 | 8/1976 | Faulkner et al. . | |
| 4,002,735 | 1/1977 | McDonie et al. | 427/77 |
| 4,023,063 | 5/1977 | King et al. . | |
| 4,039,887 | 8/1977 | McDonie et al. | 427/77 |
| 4,079,286 | 3/1978 | Popp | 313/106 |
| 4,099,079 | 7/1978 | Knapp | 313/103 |
| 4,160,185 | 7/1979 | Tomasetti . | |

*Primary Examiner*—Bruce C. Anderson

*Attorney, Agent, or Firm*—Eugene M. Whitacre; Dennis H. Irlbeck; Vincent J. Coughlin, Jr.

[57] ABSTRACT

An electron discharge device includes an evacuated envelope having therein a photocathode, an anode and an electron multiplier. The electron multiplier comprises a plurality of dynodes having a nickel substrate, an exposed surface of which has a base layer of antimony sensitized with the vapors of a plurality of alkali metals. At least one Nichrome dynode, substantially devoid of secondary emissive material is disposed adjacent to the anode. The Nichrome dynode reduces and stabilizes the anode sensitivity and gain of the device.

5 Claims, 2 Drawing Figures

PHOTOMULTIPLIER TUBE HAVING A GAIN MODIFYING NICHROME DYNODE

BACKGROUND OF THE INVENTION

The invention relates to a photomultiplier tube and particularly to a photomultiplier tube having at least one Nichrome dynode for reducing and stabilizing the anode sensitivity and gain of the tube.

In the manufacture of photomultiplier tubes it is desirable to have a photocathode which is highly sensitive to visible and near infrared light in order to obtain a high signal to noise ratio. It is also desirable to simultaneously maximize the sensitivity of both the photocathode and a plurality of dynodes to achieve high anode current gain. Method of sensitizing electron emissive surfaces of, for example, base layers of antimony on nickel substrates are well known in the art of electron discharge devices. Photoemissive materials and techniques relating thereto are, for example, described in "Photoemissive Materials" by A. H. Sommer, John Wiley and Sons, Inc., New York, 1968 and is herein incorporated by reference.

A method for simultaneously sensitizing the antimony layers of a photocathode and a plurality of dynodes having a supporting nickel substrate is described in U.S. Pat. No. 4,002,735 issued to McDonie et al. on Jan. 11, 1977, entitled, "Method of Sensitizing Electron Emissive Surfaces of Antimony Base Layers with Alkali-Metal Vapors", incorporated by reference herein.

A structure which provides a "buffer" layer between the nickel electrode substrate and the antimony base layer is described in U.S. Pat. No. 4,039,887 issued to McDonie on Aug. 2, 1977, entitled "Electron Emitter Including Porous Antimony", and incorporated by reference herein. The disclosed structure prevents alloying between the nickel substrate and the antimony base layer and provides an electrode which, when sensitized with alkali metal vapor, has the desired sensitivity.

An alternative method for preventing alloying between the nickel substrate of an electron emissive electrode and a base layer of antimony by forming an aluminum oxide film between the substrate and the base layer is disclosed in U.S. Pat. No. 4,160,185 issued to Tomasetti et al. on July 3, 1979, entitled, "Red Sensitive Photocathode Having an Aluminum Oxide Barrier Layer", and incorporated by reference herein.

The above-mentioned patents to McDonie et al., McDonie, and Tomasetti et al. have yielded photomultiplier tubes having both high photocathode sensitivity and high anode sensitivity. It has been noted however, that in some of the photomultiplier tubes, incorporating the above-described improvements, excessive anode sensitivity, i.e., anode sensitivity exceeding the permissible maximum manufacturing limit, and gain instability has been encountered. In photomultiplier tubes such as the RCA 4840 which has a multialkali photocathode comprising sodium, potassium, cesium, and antimony, and a plurality of alkali antimonide dynodes, the problem of excessive anode sensitivity and unstable gain has been pronounced. The alkali antimonide dynodes in this tube structure have effective secondary emission gains ranging from 3.5 to 8 per electrode stage. It is believed that the gain instability is caused by a change in the chemical equilibrium of the secondary emissive surface of the electrode. Such a change can be caused by either the addition or depletion of alkali materials from the photoemissive surfaces due, for example, to electron bombardment of the photoemissive surfaces, or the migration of alkali-vapors within the tube.

Since the above-mentioned tubes can only be economically produced by a batch sensitizing process requiring evaporation of excess quantities of alkali metals followed by baking the tubes to remove excess alkali materials in order to achieve the desired sensitivity, any solution to the gain problem cannot alter the existing sensitizing process.

SUMMARY OF THE INVENTION

An electron multiplier device includes a plurality of dynodes comprising a substrate having a secondary emissive material thereon and at least one additional dynode of Nichrome whose exposed surface is substantially devoid of secondary emissive material.

DETAILED DESCRIPTION OF THE PREFERRED EMBODIMENT

Figure 1:
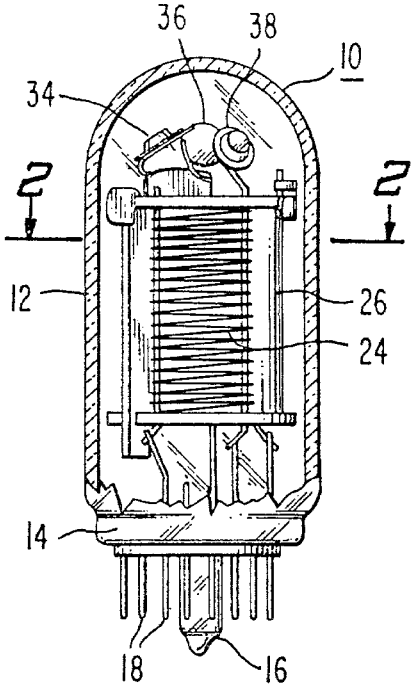
FIG. 1 is a cross-sectional view of a photomultiplier tube of the present novel structure.
Figure 2:
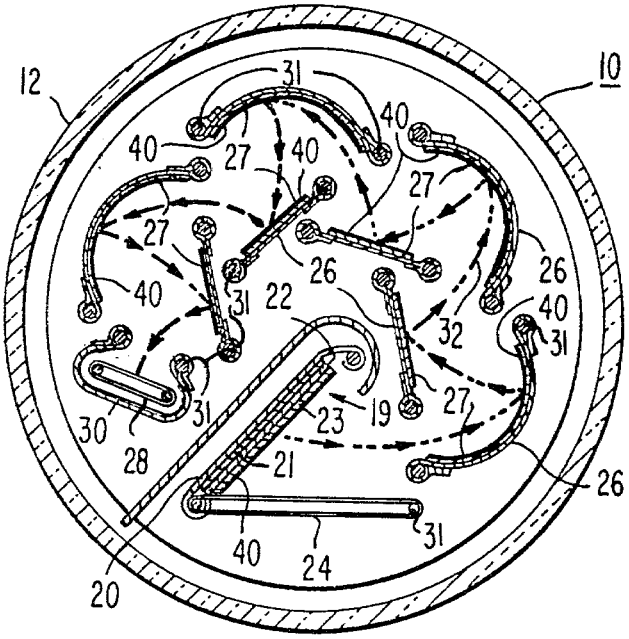
FIG. 2 is an enlarged sectional view of the tube of FIG. 1 taken along line 2—2 in which the electrodes are shown in exaggerated detail.

In a preferred embodiment of the invention, a photomultiplier tube 10, shown in FIGS. 1 and 2, is processed to activate or sensitize simultaneously various electron emissive surface portions of a plurality of electrodes within the tube's interior as described in U.S. Pat. No. 4,002,735 referenced above.

Referring now to FIG. 1, the tube 10 has a glass envelope 12, with a stem 14. The stem 14 includes a length of exhaust tubulation 16 and a number of embedded metal pins 18 for making electrical contact to the electrodes within the interior of the tube 10.

Mounted inside the tube 10 is an electrode assembly including the electrodes of tube 10 which are shown in greatly exaggerated detail in FIG. 2. The electrode assembly includes a photocathode 19 comprising, in overlay sequence: a nickel supporting substrate 20, a thin film of manganese oxide 21 on a major surface of the substrate 20, and evaporated porous and solid antimony layers 22 and 23, respectively, on the manganese oxide film 21. Angularly disposed from the photocathode 19 is a mesh electrode 24, which is followed (proceeding counter-clockwise about the tube axis) by a series or chain of eight dynodes 26 and an anode 28. The anode is partially surrounded by an anode shield or final dynode 30. Each of the dynodes 26 comprises a nickel supporting substrate on a major surface of which is disposed a thin film of solid antimony 27. The final dynode 30 comprises a nickel based alloy commercially known as Nichrome. The Nichrome dynode is devoid of antimony. A plurality of support rods 31 provide structural support for the mesh electrode 24, the photocathode 19, the dynodes 26 and 30 and the anode 28.

In the operation of tube 10, the general direction of travel of electrons emitted from the photocathode 19 is indicated by the dashed directional lines 32. Electrons emitted from the photocathode 19 are propagated and concatenated by the plurality of dynodes 26 and the final dynode 30 to the anode 28.

Located within the tube 10 between the electrode assembly and the top of the tube 10, are an enclosed potassium evaporation boat 34, an enclosed sodium evaporation boat 36, and an enclosed cesium evaporation boat 38. These boats may be either resistance-heated, or heated by RF heating methods well known in the art, to release alkali metal vapors from a charge of reactant material placed within a central cavity within their interior. Alternatively, the sodium and potassium alkali materials may be combined and placed in one evaporation boat.

As a preliminary step to the assembly of the tube 10, the Nichrome dynode 30 is cleaned to remove organic materials and to provide a pristine surface. The cleaning scheduled is detailed in Example 1. For convenience a number of dynodes are cleaned simultaneously. The Nichrome dynode 30 is made from a magnesium deoxidized, aluminum free nickel chromium alloy comprising about 19 to 20% chromium, 1% maxiumum iron, 0.25% maximum manganese, 0.10% maximum carbon, 0.45% maximum silicon, 0.01% maximum aluminum and the remainder nickel.

EXAMPLE 1

1. After the support rods 31 are attached to the Nichrome dynode 30, the dynodes are boiled in an oxide stripper made, for example, from 7 parts de-ionized water, 2 parts hydrogen peroxide and 1 part sodium hydroxide by volume.

2. The parts are then rinsed in de-ionized water.

3. Next, the parts are ultrasonically washed in hot de-ionized water for about 1 minute.

4. The parts are again rinsed in de-ionized water for about 1 minute.

5. The parts are next ultrasonically rinsed in isopropyl alcohol for about 1 minute followed by an additional rinse in isopropyl alcohol.

6. The parts are air blown dry and stored in covered glass containers in a dry nitrogen atmosphere.

7. Prior to storage the nichrome dynodes 30 are vacuum fired at 600° C. for 1 hour.

The vacuum firing of the Nichrome dynodes 30 desorbs and removes surface contaminants which may be present after the cleaning procedure. The vacuum firing thus renders the Nichrome dynodes inert to the alkali vapors generated during activation.

After assembly of the tube 10, but prior to activation of the photocathode 19 and the dynodes 26 an oven is placed around the tube 10 and the tube is baked out and evacuated for a period of from 1 to 3 hours at a temperature of from about 260° C. to eliminate contaminants from the interior. The tube 10 is thereafter cooled to room temperature.

During the entire processing, the interior of the tube is continually evacuated through the exhaust tubulation 16 by a pump system (not shown) interconnected thereto. The pump system is capable of establishing initial pressure levels of less than about $10^{-4}$ torr (preferably, pressure levels less than about $10^{-5}$ torr) within the tube interior.

After the tube 10 is baked out, the activation of exposed surface portions 40 of the photocathode 19 and the dynodes 26 which are to be sensitized by exposure to the vapors of a plurality of alkali metals may proceed in the manner described in the aforementioned U.S. Pat. No. 4,002,735.

Subsequent to the activation of the exposed surface portions 40, the tube 10 is removed from the pump system (not shown) and aged, as described hereinafter, to scrub or bombard the dynodes 26 and 30 with electrons in order to stbilize the gain and anode sensitivity of the tube by driving excess alkali materials from the surface portions 40 of dynodes 26 and from the surface of the Nichrome dynode 30. The aging consists of applying about 1000 volts to energize the tube. A light (not shown) is adjusted until approximately 50 microamperes of anode current is indicated on a meter (not shown). The "light" aging is continued for 4 hours. At the end of the 4 hours the light is turned off and the voltage is increased to approximately 1300 volts. This "dark" aging is continued for about an additional 16 hours.

Tubes having the novel final Nichrome dynode 30 described herein exhibit better anode current stability at 50 microamperes than tubes having the standard alkali antimonide final dynode. In the present structure only the final dynode 30 is formed from Nichrome. The nominal anode sensitivity of tubes produced having the novel Nichrome dynode is 1200 Amperes per lumen compared to a nominal anode sensitivity of 2400 Amperes per lumen for tubes having a final dynode with an alkali antimony secondary emissive surface.

The signal to noise ratio of tubes having the Nichrome final dynode is lower than the signal to noise ratio of tubes with an alkali antimonide final dynode; however since the low secondary emission gain Nichrome dynode is adjacent to the anode, the noise contribution from the last dynode is small and the performance of the tube is substantially unaffected (see RCA Photomultiplier Manual, PT-61 p. 62 (1970) incorporated by reference herein). Briefly, the relative contribution of any dynode stage to the total gain fluctuation or variance decreases with the proximity of the dynodes in the propagating and concatenating chain to the output or anode. The first stage contributes most to the total variance and the final stage contributes least.

GENERAL CONSIDERATIONS

In attempting to find a stable, inert material for use as a final non-antimony dynode, applicants' evaluated nickel, stainless steel and Nichrome evaporated on a nickel substrate. Measurements of the secondary emission gain of the nickel and stainless steel substrates revealed a high initial secondary emission ranging from 3 to 4. The secondary emission gain of the nickel and stainless steel was less stable than the prior art alkali antimonide final dynode, and furthermore the tubes having either nickel or stainless steel final dynodes exhibited an undesirable hysteresis or memory effect which allowed the degraded secondary emission of the final dynode to recover when the operating voltage was removed from the tube. This hysteresis effect is undesirable because the tubes cannot maintain a stable output current.

Tubes made with final dynodes comprising Nichrome evaporated on a nickel substrate showed good stability and a reduction in gain of about one-half the gain of the alkali antimonide final dynode; however, the preparation of the nichrome evaporated dynodes is an expensive, complicated process that introduces undesirable variables which are absent in "solid" Nichrome final dynodes as described herein.

While the above-described structure utilizes only one Nichrome dynode to reduce and stabilize the anode sensitivity and the gain of the tube, it is within the scope of the invention to increase the number of Nichrome dynodes in order to achieve the anode sensitivity and gain stability desired. As described herein, since the gain fluctuation or variance of the dynodes decreases with the proximity of the dynodes to the output or anode, additional Nichrome dynodes would be added to the propagating and concatenating chain at the anode end of the electron multiplier. Specifically, the additional Nichrome dynodes would be mutually adjacent to one another and adjacent to the anode. By locating the additional Nichrome dynodes adjacent to the anode, the signal to noise ratio of the photomultiplier tube will be at least detrimentally effected.

What is claimed is:

1. An electron discharge multiplier device including an evacuated envelope having therein a photocathode, an anode, and a plurality of dynodes for propagating and concatenating electron emission from said photocathode to said anode, each of a plurality of said dynodes consisting of a supporting substrate having a secondary emissive material on an exposed surface thereof, and at least one of said dynodes being adjacent to said anode and comprising nichrome whose exposed surface is substantially devoid of secondary emissive material to provide gain reduction and stability.

2. An electron discharge device including an evacuated envelope having therein a photocathode, an anode, an electron multiplier including a plurality of dynodes for propagating and concatenating electron emission from said photocathode to said anode, said electron multiplier having a plurality of dynodes comprising a nickel substrate having an exposed surface comprising a base layer of antimony sensitized with the vapors of a plurality of alkali metals, and at least one Nichrome dynode adjacent to said anode said Nichrome dynode having an exposed surface substantially devoid of secondary emissive material to provide gain reduction and stability.

3. An electron discharge device including an evacuated envelope having therein a photocathode, an anode, and an electron multiplier for propagating and concatenating electron emission from said photocathode to said anode, said electron multiplier having a plurality of dynodes comprising a nickel substrate having an exposed surface including a base layer of antimony sensitized with the vapors of a plurality of alkali metals, and a plurality of mutually adjacent Nichrome dynodes, said plurality of Nichrome dynodes being adjacent to said anode, said plurality of Nichrome dynodes being fewer than said plurality of dynodes comprising a nickel substrate, said Nichrome dynodes having an exposed surface substantially devoid of secondary emissive material to provide gain reduction and stability.

4. An electron discharge device including an evacuated envelope having therein a photocathode, an anode, an electron multiplier including a plurality of electrodes for propagating and concatenating electron emission from said photocathode to said anode, said electron multiplier having a plurality of dynodes comprising a nickel substrate having an exposed surface comprising a base layer of antimony sensitized with the vapors of a plurality of alkali metals, and at least one Nichrome electrode adjacent to said anode to provide gain reduction and stability.

5. An electron discharge device including an evacuated envelope having therein a photocathode, an anode, and an electron multiplier for propagating and concatenating electron emission from said photocathode to said anode, said electron multiplier having a plurality of dynodes comprising a nickel substrate having an exposed surface including a base layer of antimony sensitized with the vapors of a plurality of alkali metals, and a plurality of mutually adjacent Nichrome electrodes, said plurality of Nichrome electrodes being adjacent to said anode, said plurality of Nichrome electrodes being fewer than said plurality of dynodes comprising a nickel substrate, said Nichrome electrodes having an exposed surface substantially devoid of secondary emissive material to provide gain reduction and stability.

* * * * *